US008102386B2

(12) United States Patent
Park et al.

(10) Patent No.: US 8,102,386 B2
(45) Date of Patent: Jan. 24, 2012

(54) DRIVING APPARATUS OF DISPLAY DEVICE AND METHOD FOR DRIVING DISPLAY DEVICE

(75) Inventors: Jae-Hyeung Park, Seoul (KR); Byung-Kil Jeon, Anyang-si (KR); Hyoung-Sik Nam, Incheon-si (KR)

(73) Assignee: Samsung Electronics Co., Ltd. (KR)

( * ) Notice: Subject to any disclaimer, the term of this patent is extended or adjusted under 35 U.S.C. 154(b) by 502 days.

(21) Appl. No.: 11/968,750

(22) Filed: Jan. 3, 2008

(65) Prior Publication Data

US 2008/0165106 A1 Jul. 10, 2008

(30) Foreign Application Priority Data

Jan. 4, 2007 (KR) ..... 10-2007-0000913

(51) Int. Cl.
*G09G 5/00* (2006.01)

(52) U.S. Cl. ..... 345/204; 345/87; 345/698; 345/3.2; 348/441

(58) Field of Classification Search ..... 345/87–103, 345/204–205, 208–210, 698, 699, 3.2; 348/441
See application file for complete search history.

(56) References Cited

U.S. PATENT DOCUMENTS

| | | | | |
|---|---|---|---|---|
| 5,138,305 | A * | 8/1992 | Tomiyasu | 345/3.1 |
| 5,168,362 | A * | 12/1992 | Yoshida | 348/696 |
| 6,118,486 | A * | 9/2000 | Reitmeier | 348/441 |
| 6,313,813 | B1 * | 11/2001 | Narui et al. | 345/3.2 |
| 6,329,981 | B1 * | 12/2001 | Lin et al. | 345/204 |
| 6,512,239 | B1 * | 1/2003 | Weiss et al. | 250/559.4 |
| 6,661,846 | B1 * | 12/2003 | Ota | 375/240.28 |
| 6,667,730 | B1 * | 12/2003 | Taguchi et al. | 345/99 |
| 6,760,059 | B2 * | 7/2004 | Ham | 348/87 |
| 7,605,787 | B2 * | 10/2009 | Akutsu et al. | 345/89 |
| 2002/0003522 | A1 | 1/2002 | Baba et al. | |
| 2002/0180718 | A1 * | 12/2002 | La | 345/204 |
| 2002/0196218 | A1 * | 12/2002 | Ham | 345/87 |
| 2003/0095088 | A1 * | 5/2003 | Ham | 345/87 |
| 2004/0150605 | A1 * | 8/2004 | Arimoto et al. | 345/100 |
| 2004/0196227 | A1 | 10/2004 | Lee | |
| 2005/0243051 | A1 | 11/2005 | Kudo et al. | |
| 2006/0061690 | A1 * | 3/2006 | De Haan et al. | 348/625 |
| 2006/0125812 | A1 * | 6/2006 | Lee | 345/204 |

FOREIGN PATENT DOCUMENTS

| | | |
|---|---|---|
| JP | 05-188351 | 7/1993 |
| JP | 06-118928 | 4/1994 |
| JP | 10-319920 | 12/1998 |
| JP | 2000-023063 | 1/2000 |

(Continued)

*Primary Examiner* — Lun-Yi Lao
*Assistant Examiner* — Tom Sheng
(74) *Attorney, Agent, or Firm* — Cantor Colburn LLP

(57) ABSTRACT

An apparatus for driving a display device includes a signal controller which converts an input image signal of a first frame frequency into a plurality of output image signals of a second frame frequency and outputs the output image signals, and a data driver which selects the data voltages corresponding to the output image signals among one group of gray voltages and applies the data voltages to pixels, wherein the input image signal includes at least a first input image signal and a second input image signal, the output image signal includes a first output image signal corresponding to the first input image signal and a second output image signal corresponding to the second input image signal, and a pixel frequency of the first and second output image signals are the same.

9 Claims, 4 Drawing Sheets

FOREIGN PATENT DOCUMENTS

| | | | | |
|---|---|---|---|---|
| JP | 2000-132134 | | | 5/2000 |
| JP | 2002-341823 | | | 11/2002 |
| JP | 2005-275315 | | | 10/2005 |
| KR | 1020020008793 | A | | 1/2002 |
| KR | 1020020013715 | A | | 2/2002 |
| KR | 1020030026899 | A | | 4/2003 |
| KR | 1020040068419 | A | | 7/2004 |
| KR | 10-2005-0056796 | | * | 6/2005 |
| KR | 2005-0056796 | | * | 6/2005 |
| KR | 1020050056796 | A | | 6/2005 |
| KR | 1020060061137 | A | | 6/2006 |

* cited by examiner

DRIVING APPARATUS OF DISPLAY DEVICE AND METHOD FOR DRIVING DISPLAY DEVICE

This application claims priority to Korean Patent Application No. 10-2007-0000913, filed on Jan. 4, 2007, and all the benefits accruing therefrom under 35 U.S.C. §119, the contents of which in its entirety are herein incorporated by reference.

BACKGROUND OF THE INVENTION (a) Field of the Invention

The present invention relates to a driving apparatus of a display device and a method of driving a display device. More particularly, the present invention relates to a driving apparatus changing a frame frequency of the display device, and a method of driving the display device to change the frame frequency of the display device.

(b) Description of the Related Art

Generally, a liquid crystal display ("LCD") includes two display panels that respectively have pixel electrodes and a common electrode, and a liquid crystal ("LC") layer disposed therebetween and having dielectric anisotropy. The pixel electrodes are arranged in a matrix shape, and are connected to switching elements such as thin film transistors ("TFTs") to sequentially receive data voltages by rows. The common electrode may be provided on the same or a different display panel from the pixel electrode, and receives a common voltage. The pixel electrodes and the common electrode, and the LC layer therebetween, form LC capacitors from a circuit perspective, and the LC capacitors are a primary unit for forming a pixel with the switching elements connected thereto.

In the LCD, a voltage is applied to the pixel and common electrodes to generate an electric field on the LC layer, and by controlling the strength of the electric field, transmittance of light that passes through the LC layer is controlled to thus obtain a desired image. In this case, in order to prevent a degradation phenomenon or flickering generated as the electric field is applied in one direction for a long period of time, polarity of data voltages with respect to a common voltage is inverted by frame, row, or pixel.

Generally, input image signals that are input to a signal controller controlling the outputs of the data voltages are divided into two types. That is to say, the input image signals are divided into film image signals such as a movie that is displayed with a frame frequency of about 24 Hz (i.e., the number of frames displayed during 1 second), and general video image signals that are displayed with a frame frequency of about 60 Hz.

Accordingly, film image signals of about 24 Hz are input to the signal controller through a graphics controller with a frame frequency (input frequency) of about 60 Hz, and are appropriately signal-processed to convert the corresponding data voltages to be transmitted to a data driver with a predetermined frame frequency (output frequency).

As described, input image signals such as film image signals and video image signals having the same frame frequency are adapted to a frame rate conversion ("FRC") technique to improve the images, particularly picture quality of motion pictures, and to adapt techniques such as a frame insert for motion compensation such that the output frequency is not the same as the input frequency.

In this case, the pixel frequency, i.e., the number of pixels displayed during 1 second, is changed in the method of changing the frame frequency. As examples, a film image signal that is displayed at about 24 Hz is changed and output to have a frame frequency of about 72 Hz as an output frequency, and a video image signal that is displayed at about 60 Hz is changed and output to have an output frequency of about 120 Hz.

However, when the frame frequency is changed to an output frequency with a different magnitude, the pixel frequency is also changed.

Firstly, when the pixel frequency is also changed, the charging times of the pixels between the video image signal and the film image signal become different. That is, since the charging time of the pixel is determined by the number of pixel columns displayed during one second (hereinafter referred to as "horizontal frequency"), if the frame frequency is changed, because the horizontal frequency is also changed by the change of the pixel frequency, charging times become different.

Secondly, when the pixel frequency is also changed, because the frequency of the input image signal input that is input into the signal controller that controls the output of the data voltage by appropriately processing the input image signal is proportional to the pixel frequency, if the frame frequency is changed, the frequency of the input image signal is also changed. Generally, when the pixel frequency is abruptly changed, the input image signal is determined as an unstable state, the signal controller is operated in a fail-safe mode, and a predetermined image or a black image is displayed until the pixel frequency is stable. However, when the frame frequency is changed, because the pixel frequency is changed, an abnormal image may be displayed by the change of the frame frequency during the predetermined time regardless of the state of the input image signal.

BRIEF SUMMARY OF THE INVENTION

According to the present invention, it has been determined herein that because the frequencies provided to a conventional display device deviate from the frequency region determined by a low voltage differential signaling ("LVDS") mode, stable signal receiving processing is not completed.

It has also been determined herein, according to the present invention, that when the input image signal is frequently changed between the video image signal and the film image signal, as is done in a conventional driving apparatus, the signal controller may be abnormally operated in a stable mode.

The present invention provides for a change of frame frequency without a change of operation characteristics of a display device according to a characteristic of an input image signal.

The present invention also provides for a change of the frame frequency according to a large difference and a small difference to display images of a different frame frequency when an input image signal is compared with the previous frame.

An apparatus for driving a display device according to exemplary embodiments of the present invention includes a signal controller which converts an input image signal of a first frame frequency into a plurality of output image signals of a second frame frequency and outputs output image signals, and a data driver which selects data voltages corresponding to the output image signals among one group of gray voltages and applies the data voltages to pixels, wherein the input image signal includes at least a first input image signal and a second input image signal, the output image signal includes a first output image signal corresponding to the first input image signal and a second output image signal corresponding to the second input image signal, and pixel frequencies of the first and second output image signals are the same.

The signal controller may change the pixel frequency of the input image signal of a first frame frequency into an output image signal of a second frame frequency.

The signal controller may calculate a number of inactive pixel rows based on the second frame frequency and control the pixel frequencies of the first and second output image signals to be the same.

The first input image signal may be a video image signal, and the second input image signal may be a film image signal.

The signal controller may include a frame memory, and it may include a line memory.

BRIEF DESCRIPTION OF THE DRAWINGS

The above and other aspects, features and advantages of the present invention will become more readily apparent by describing in further detail exemplary embodiments thereof with reference to the accompanying drawings, in which.

DETAILED DESCRIPTION OF THE INVENTION

Figure 1:
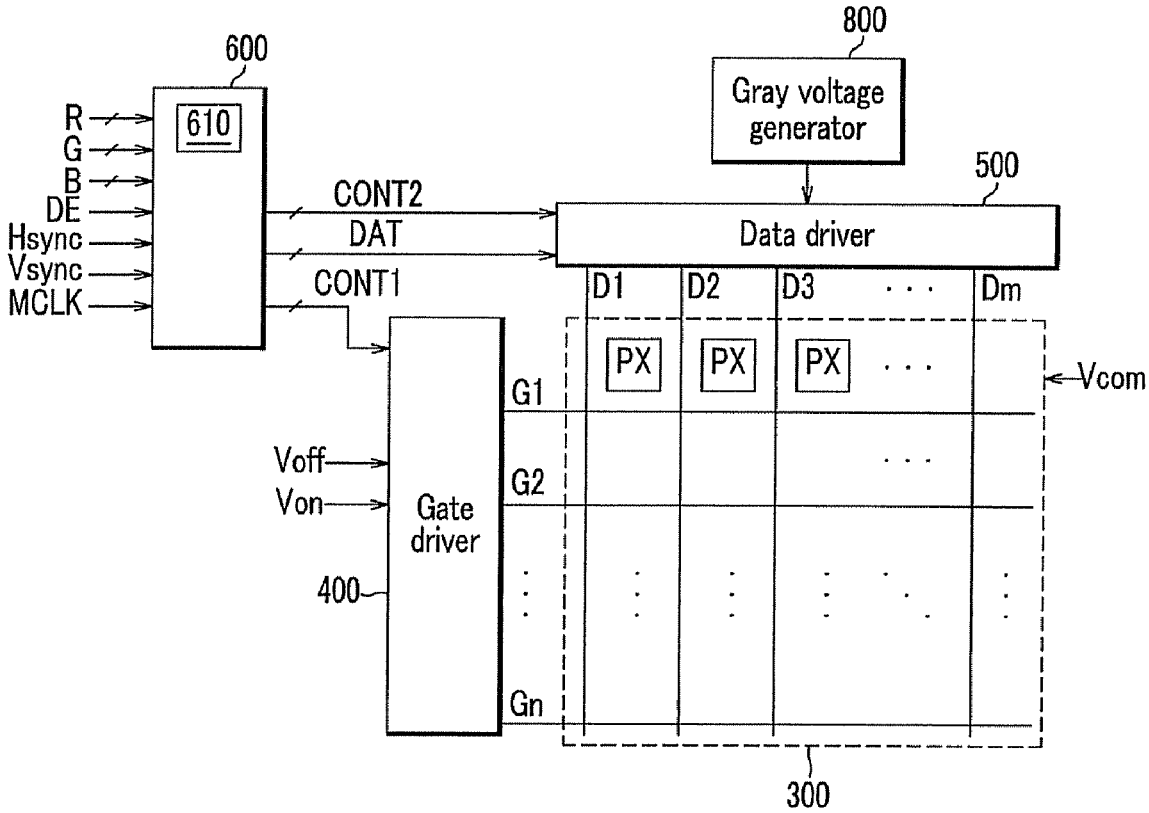
FIG. 1 is a block diagram of an exemplary liquid crystal display ("LCD") according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

To clarify multiple layers and regions, the thicknesses of the layers are enlarged in the drawings, and like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present. As used herein, the term "and/or" includes any and all combinations of one or more of the associated listed items.

It will be understood that although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including," when used in this specification, specify the presence of stated features, regions, integers, steps, operations, elements and/or components, but do not preclude the presence or addition of one or more other features, regions, integers, steps, operations, elements, components and/or groups thereof.

Furthermore, relative terms, such as "lower" or "bottom" and "upper" or "top" may be used herein to describe one element's relationship to other elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on the "upper" side of the other elements. The exemplary term "lower" can, therefore, encompass both an orientation of "lower" and "upper," depending upon the particular orientation of the figure. Similarly, if the device in one of the figures were turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning which is consistent with their meaning in the context of the relevant art and the present disclosure, and will not be interpreted in an idealized or overly formal sense unless expressly so defined herein.

Now, an apparatus for driving a liquid crystal display ("LCD") as one exemplary embodiment of a display device and an apparatus for driving a display device according to the present invention will be described with reference to the drawings.

First, an exemplary LCD device according to one exemplary embodiment of the present invention will be described in detail with reference to FIGS. 1 and 2.

Figure 2:
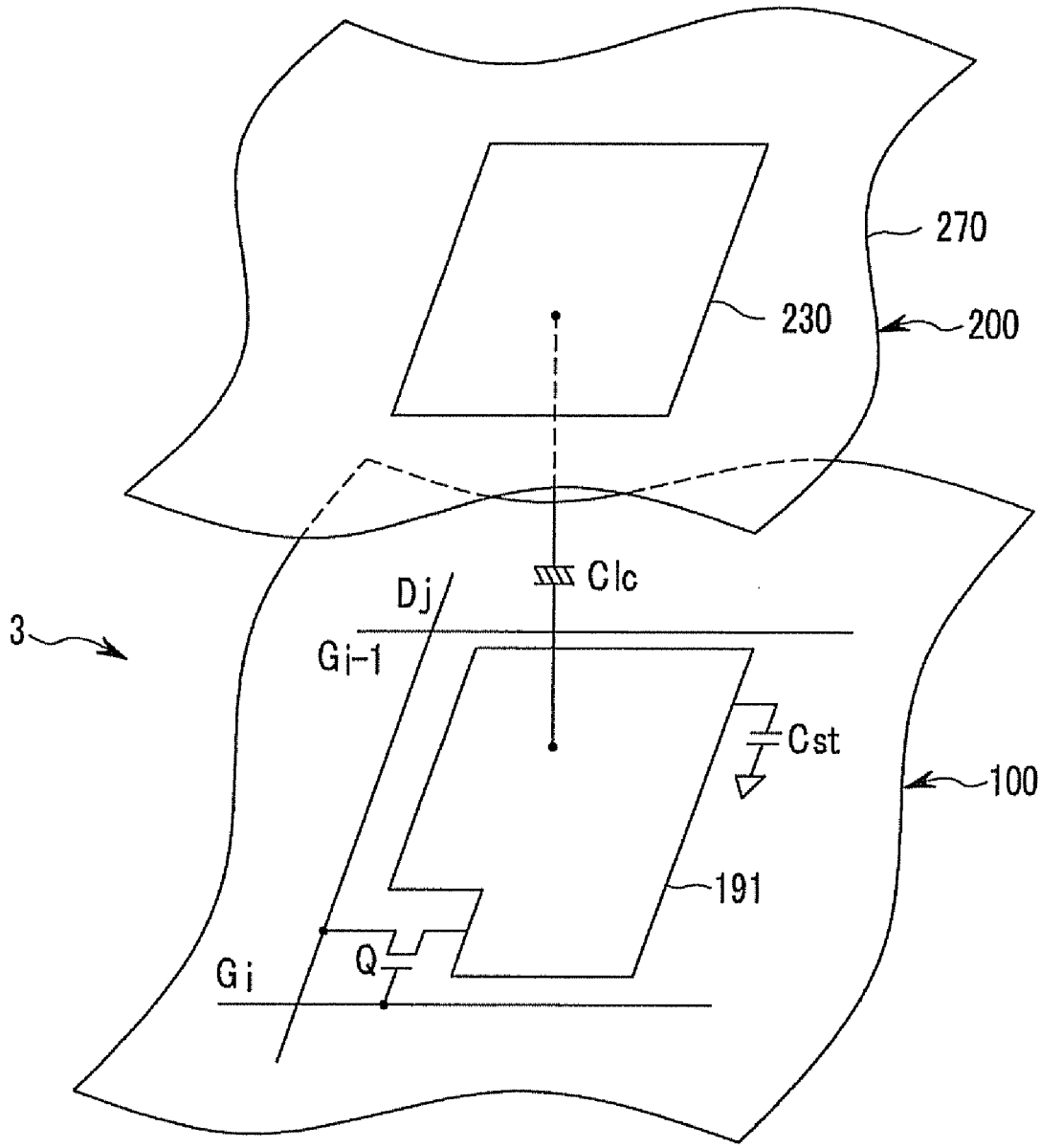
FIG. 2 is an equivalent circuit diagram of an exemplary pixel of an exemplary LCD according to an exemplary embodiment of the present invention.

FIG. 1 is a block diagram of an LCD according to one exemplary embodiment of the present invention, and FIG. 2 is an equivalent circuit diagram of one exemplary pixel of the exemplary LCD according to one exemplary embodiment of the present invention.

As shown in FIG. 1, an according to one exemplary embodiment of the present invention includes a liquid crystal ("LC") panel assembly 300, a gate driver 400, a data driver 500, a gray voltage generator 800, and a signal controller 600.

Referring to FIG. 1, in the circuital view, the LC panel assembly 300 includes a plurality of signal lines G1-Gn and D1-Dm, and a plurality of pixels PX connected thereto and arranged substantially in a matrix. In the structural view shown in FIG. 2, the LC panel assembly 300 includes lower and upper panels 100 and 200 that are opposite to each other, and an LC layer 3 interposed between the lower and upper panels 100 and 200.

The signal lines G1-Gn and D1-Dm include a plurality of gate lines G1-Gn transmitting gate signals (also referred to as "scanning signals"), and a plurality of data lines D1-Dm transmitting data signals. The gate lines G1-Gn extend substantially in a row direction, a first direction, and substantially parallel to each other, while the data lines D1-Dm extend substantially in a column direction, a second direction, and substantially parallel to each other. The first direction may be substantially perpendicular to the second direction.

Each pixel PX, e.g., a pixel PX connected to an i-th (i=1, 2, . . . , n) gate line Gi and a j-th (j=1, 2, . . . , m) data line Dj, includes a switching element Q connected to the signal lines Gi and Dj, and an LC capacitor Clc and a storage capacitor Cst connected to the switching element Q. In an alternative exemplary embodiment, the storage capacitor CST may be omitted if necessary.

The switching element Q is a three-terminal element, such as a thin film transistor ("TFT"), provided on the lower panel 100. A control terminal, such as a gate electrode, of the switching element Q is connected to the gate line Gi, an input terminal thereof, such as a source electrode, is connected to the data line Dj, and an output terminal thereof, such as a drain electrode, is connected to the LC capacitor Clc and the storage capacitor Cst.

The LC capacitor Clc includes a pixel electrode 191 of the lower panel 100 and a common electrode 270 of the upper panel 200 as two terminals, and the LC layer 3 between the two electrodes 191 and 270 serves as a dielectric material. The pixel electrode 191 is connected with the switching element Q, and the common electrode 270 is formed on the entire surface, or substantially the entire surface, of the upper panel 200 and receives a common voltage Vcom. In an alternative exemplary embodiment, unlike that shown in FIG. 2, the common electrode 270 can be provided on the lower panel 100, and in this case, at least one of the two electrodes 191 and 270 can have a linear or bar shape.

The storage capacitor Cst that serves as an auxiliary to the LC capacitor Clc is formed as a separate signal line (not shown) provided on the lower panel 100 and the pixel electrode 191 overlapping it with an insulator interposed therebetween, and a predetermined voltage such as the common voltage Vcom or the like is applied to the separate signal line. Also, the storage capacitor Cst can be formed as the pixel electrode 191 overlaps with the immediately previous gate line (i−1) by the medium of the insulator.

Meanwhile, in order to perform color display, each pixel PX specifically displays one color in a set of colors, such as primary colors (spatial division), or the pixels PX alternately display the colors over time (temporal division), which causes the colors to be spatially or temporally synthesized, thereby displaying a desired color. An example of the set of colors may include primary colors, and may include three colors including red, green, and blue colors. FIG. 2 is an example of the spatial division. As shown in FIG. 2, each of the pixels PX includes a color filter 230 representing one of the colors and that is disposed in a region of the upper display panel 200 corresponding to a pixel electrode 191. In an alternative exemplary embodiment, unlike as shown in FIG. 2, the color filter 230 may be formed above or below the pixel electrode 191 of the lower display panel 100.

At least one polarizer (not shown) for polarizing light may be attached to an outer surface of the LC panel assembly 300.

Referring to FIG. 1 again, the gray voltage generator 800 generates all gray voltages or a limited number of gray voltages (hereinafter referred to as "reference gray voltages") related to the transmittance of the pixels PX. The (reference) gray voltages may include gray voltages that have a positive value and gray voltages that have a negative value with respect to the common voltage Vcom.

The gate driver 400 is connected to the gate lines G1-Gn of the LC panel assembly 300 and synthesizes a gate-on voltage Von and a gate-off voltage Voff to generate gate signals, which are applied to the gate lines G1-Gn.

The data driver 500 is connected to the data lines D1-Dm of the LC panel assembly 300, and selects gray voltages supplied from the gray voltage generator 800 and then applies the selected gray voltages to the data lines D1-Dm as data voltages. However, in the case when the gray voltage generator 800 supplies only a limited number of reference gray voltages rather than supplying all gray voltages, the data driver 500 divides the reference gray voltages to generate desired data voltages.

The signal controller 600 includes a signal processor 610, and it controls the gate driver 400 and the data driver 500. The signal processor 610 may include a frame memory, a line memory, etc.

Each of the driving circuits 400, 500, 600, and 800 may be directly mounted as at least one integrated circuit ("IC") chip on the LC panel assembly 300 or on a flexible printed circuit film (not shown) in a tape carrier package ("TCP") type, which are attached to the LC panel assembly 300, or may be mounted on a separated printed circuit board ("PCB", not shown). Alternatively, the driving circuits 400, 500, 600, and 800 may be integrated with the LC panel assembly 300 along with the signal lines G1-Gn and D1-Dm and the TFT switching elements Q. Further, the driving circuits 400, 500, 600, and 800 may be integrated as a single chip. In this case, at least one of the driving circuits or at least one circuit device constituting the driving circuits may be located outside the single chip.

Now, the operation of the above-described LCD will be explained in detail.

The signal controller 600 is supplied with input image signals R, G, and B and input control signals for controlling the display thereof from an external graphics controller (not shown). The input image signals R, G, and B contain luminance information of each pixel PX. The luminance has a predetermined number of grays, such as 1024 ($=2^{10}$), 256 ($=2^{8}$), or 64 ($=2^{6}$). The input control signals include, for example, a vertical synchronization signal Vsync, a horizontal synchronization signal Hsync, a main clock signal MCLK, and a data enable signal DE.

The signal controller 600 processes the input image signals R, G, and B in such a way so as to be suitable for the operating conditions of the LC panel assembly 300 based on the input image signals R, G, and B and the input control signals. The signal controller 600 generates a gate control signal CONT1, a data control signal CONT2, and so on, and it sends the gate control signal CONT1 to the gate driver 400 and the data control signal CONT2 and a processed image signal DAT to the data driver 500. Here, the signal processor 610 of the signal controller 600 may change the frequency of the input image signal and output it to the data driver 500. This change operation of the frequency performed by the signal controller 600 will be described in detail further below.

The gate control signal CONT1 includes a scanning start signal STV to instruct the start of scanning, and at least one clock signal to control an output cycle of the gate-on voltage Von. The gate control signal CONT1 may further include an output enable signal OE to define a sustaining time of the gate-on voltage Von.

The data control signal CONT2 includes a horizontal synchronization start signal STH informing the transmission start of image data for a row of pixels PX, a load signal LOAD to instruct the data signal to be applied to the data lines D1-Dm, and a data clock signal HCLK. The data control signal CONT2 may further include an inversion signal RVS to invert the voltage polarity of the data signal for the common voltage Vcom (hereinafter, "the voltage polarity of the data signal for the common voltage" is abbreviated to "the polarity of the data signal").

According to the image data control signal CONT2 from the signal controller 600, the image data driver 500 receives the digital image signal DAT for the pixel PX of one pixel row, selects the gray voltage from the gray voltage generator 800 corresponding to each digital image signal DAT to transform the image data signal, and applies the transformed signal to the corresponding image data lines D1-Dm.

According to the image scan control signal CONT1 from the signal controller 600, the gate driver 400 applies the gate-on voltage Von to the image scanning lines G1-Gn, the gate lines, to turn on the switching elements Q connected to the image scanning lines G1-Gn. The image data signal applied to the image data lines D1-Dm is then applied to a corresponding pixel PX through a turned-on switching element Q.

The difference between the voltage of the image data signal applied to the pixel PX and the common voltage Vcom is represented as the charge voltage of the LC capacitor Clc, that is, the pixel voltage. According to the magnitude of the pixel voltage, the arrangement of the LC molecules within the LC layer 3 is differentiated. Accordingly, the polarization of the light that passes through the LC layer 3 changes. The variation of the polarized light is expressed as a transmittance variance of the light, and therefore the pixel PX expresses the luminance expressed by the grayscale of the video signals DAT.

The above operation is repeatedly performed having a horizontal period 1H corresponding to one period of the horizontal synchronization signal Hsync and the data enable signal DE, the gate-on voltage Von is sequentially applied to all the gate lines G1 to Gn, and the data voltage is applied to all the pixels PX so as to display an image of one frame.

After one frame ends, a subsequent frame is started, and a state of the inversion signal RVS applied to the data driver 500 to invert the polarity of the data voltage applied to each pixel PX from the polarity of a previous frame is controlled, which is referred to as "frame inversion". In this case, in one frame, the polarity of the data voltage flowing through one data line may be periodically changed according to characteristics of the inversion signal RVS (e.g., row inversion and dot inversion), or the polarities of the data voltage applied to one pixel row may be different (e.g., column inversion and dot inversion).

Next, the change operation of the input frequency of the signal processor 610 of the signal controller 600 will be described in detail.

Firstly, the change principle of the input frequency in the signal processor 610 according to an exemplary embodiment of the present invention will be described.

A pixel frequency f_p and a horizontal frequency f_h are obtained as shown in the following Equation 1 and Equation 2.

$$f_p=(h_\text{active}+h_\text{blank})\times f_h=(h_\text{active}+h_\text{blank})\times(v_\text{active}+v_\text{blank})\times f_v \quad \text{(Equation 1)}$$

$$f_h=(v_\text{active}+v_\text{blank})\times f_v \quad \text{(Equation 2)}$$

Here, the term h_active represents the number of active pixels that are substantially displayed among the pixels in one pixel row, and the term h_blank represents the number of inactive pixels that are not substantially displayed among the pixels in one pixel row. The term v_active represents the number of active pixel rows that are substantially displayed among the pixel rows in one frame, the term v_blank represents the number of inactive pixel rows that are not substantially displayed among the pixel rows in one frame (hereinafter referred to as "inactive pixel row number"), and the term f_v represents a frame frequency.

In Equation 2, the frame frequency f_v is obtained as shown in the following Equation 3.

$$f_v=f_h/(v_\text{active}+v_\text{blank}) \quad \text{(Equation 3)}$$

The frame frequency f_v may be adjusted by changing the pixel frequency f_p through Equation 1.

In Equation 3, the frame frequency f_v is inversely proportional to the inactive pixel row number v_blank. Therefore, if the inactive pixel row number v_blank is changed instead of changing the horizontal frequency f_h, then the frame frequency f_v is changed. Here, if the frame frequency f_v is changed, then the pixel frequency f_p is also changed by Equation 1, such that the frame frequency f_v is changed to the different magnitude and the pixel frequency f_p of the video image signal and the film image signal are different to each other. However, in Equation 1, because the pixel frequency f_p is changed according to the inactive pixel row number v_blank, if the inactive pixel row number v_blank is changed, then the pixel frequency f_p is resultantly changed. Accordingly, when the pixel frequency f_p of the video image signal and the film image signal are different through the change of the frame frequency f_v, the pixel frequencies f_p of the two image signals are adjusted to be the same by increasing or decreasing the inactive pixel row number v_blank.

Accordingly, the type of input image signal input into the signal processor 610 of the signal controller 600 is selected in the present exemplary embodiment, the inactive pixel row number v_blank is changed according to the type of selected input image signal to change the desired frame frequency f_v, and the same pixel frequency f_p may exist regardless of the type of input image signal. Because the minimum value of the inactive pixel row number v_blank is determined according to the configuration and the number of the driver IC of the LCD, but the maximum value of the inactive pixel row number v_blank is not determined, it is not difficult for the signal controller 600 to increase the inactive pixel row number v_blank.

The operation of the signal processor 610 changing the frame frequency of the input image signal will be described with reference to FIG. 3 according to this principle.

Figure 3:
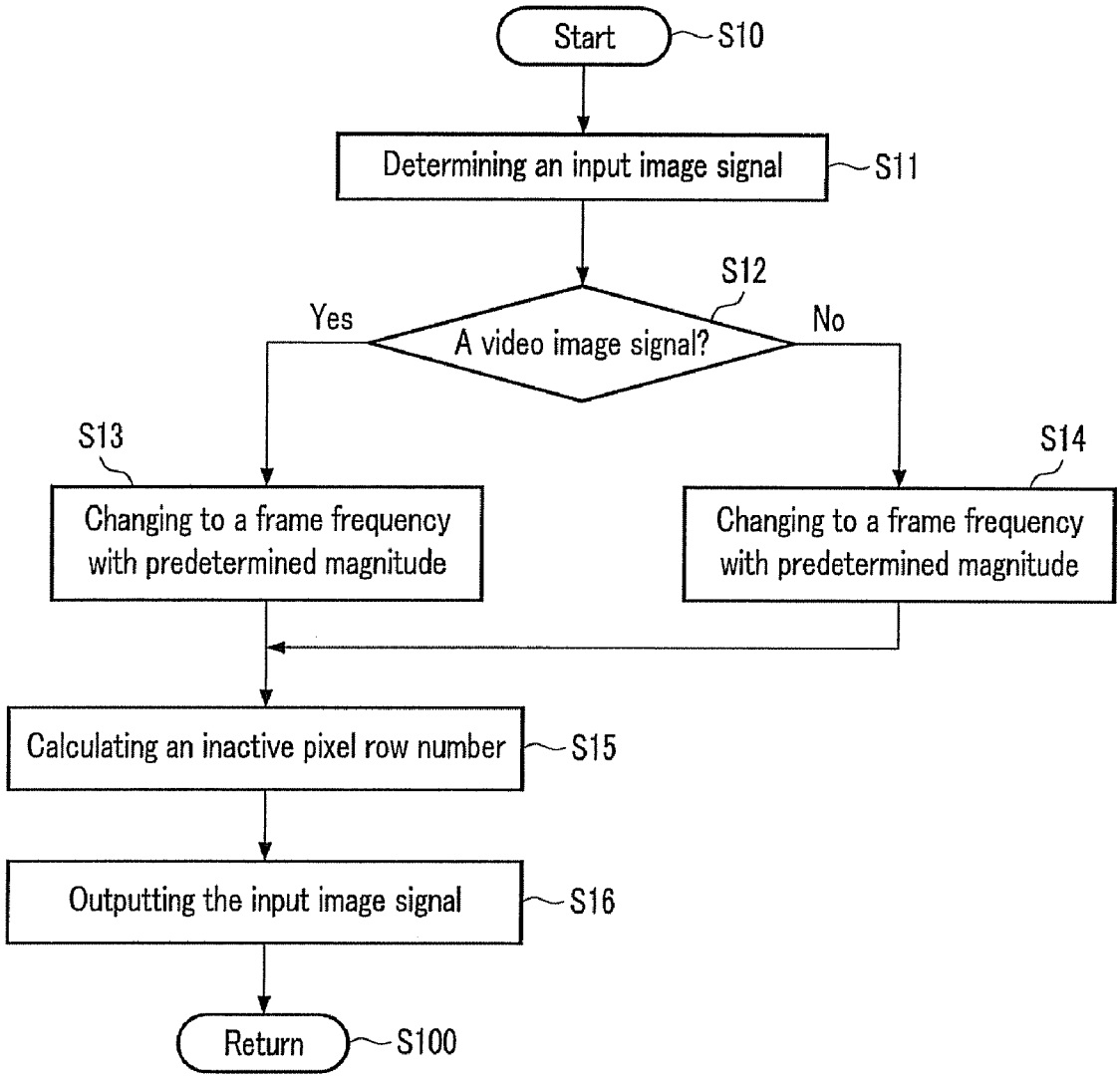
FIG. 3 is an operation flowchart of an exemplary signal controller according to an exemplary embodiment of the present invention; and, FIG. 4 is an operation flowchart of an exemplary signal controller according to another exemplary embodiment of the present invention.

FIG. 3 is an operation flowchart of the exemplary signal processor 610 according to an exemplary embodiment of the present invention.

Firstly, if the operation is started, the signal processor 610 reads the input image signal R, G, and B having a predetermined input frequency, for example a frame frequency of about 60 Hz and a pixel frequency of 80 MHz or about 80 MHz (S11), and determines the type of the input image signal R, G, and B (S12). That is, it is determined whether the input image signal R, G, and B is a video image signal or a film image signal. When the read input image signal R, G, and B is a video image signal, the signal processor 610 changes the predetermined frame frequency, for example to the frame frequency of 120 Hz or about 120 Hz (S13). However, when the input image signal R, G, and B is a film image signal, the signal processor 610 changes the predetermined frame frequency, for example to the frame frequency of 72 Hz or about 72 Hz (S14). Here, to change the desired frame frequency, because the pixel frequency of each input image signal R, G, and B is adjusted and changed, and the magnitude of the changed frame frequency of the video image signal and the film image signal are different, the adjust-pixel frequency is also different.

Next, to compensate the adjust-pixel frequency with the different magnitude on the video image signal and the film image signal to be the same, the signal processor 610 calculates the inactive pixel row number (v_blank) that is newly inserted (S15).

That is to say, the signal processor 610 calculates the added inactive pixel row number according to the changed frame frequency based on the following Equation 4.

$$(v_active+v_blank1)\times f_v1=(v_active+v_blank2)\times f_v2 \quad \text{(Equation 4)}$$

Here, the term f_v1 represents a frame frequency that is the same as that of the input image signal R, G, and B before the change, the term v_blank1 is a number of inactive pixel rows before the change, the term f_v2 represents a frame frequency of the input image signal R, G, and B after the change, and the term v_blank2 is a number of inactive pixel rows after the change.

As an example, when a video image signal with a frame frequency of about 60 Hz is changed to the frame frequency of about 120 Hz, the added inactive pixel row number is about 6, and when the film image signal with a frame frequency of about 60 Hz is changed into a frame frequency of about 72 Hz, the added inactive pixel row number is about 522.

Next, the signal processor 610 respectively transmits the input image signal R, G, and B with the changed frame frequency to the data driver 500, and the inactive pixel row data with a number that is respectively added are also transmitted to the data driver 500 (S16). For this, the signal controller 600 includes a frame memory that stores the image signal on one frame and a line memory that stores the image signal of one row, as described above. Also, the gray of the image signal in the inactive pixel row with the added number may be a black gray level.

In this way, when the pixel frequency is different according to the type of input image signal by the change of the frame frequency in the present exemplary embodiment, the inactive pixel row number is increased or decreased to have the same pixel frequency.

When dynamic capacitance compensation ("DCC") control in which the data voltage to be applied to the pixel PX is smaller or larger than the data voltage based on the output image signal to reduce the change time of the pixels PX is executed, the output image signal is read from the storing device that stores the compensation output image signal for the DCC control after changing each to correspond to the frame frequency according to the type of input image signal.

At this time, the compensation output image signal is read from the external storing device after changing the frame frequency of the input image signal to the desired frame frequency, and the normal DCC control is not executed during initial several frames due to the delay of the predetermined time.

Accordingly, to prevent this delay, the output image signal corresponding to each changed frame frequency is stored by using a lookup table provided in the signal controller 600, and when the operation of the signal controller 600 is started, the compensation output image signal that is stored in the lookup table is read and the compensation output image signal corresponding to the changed frame frequency is directly accessed whenever the frame frequency of the input image signal is changed to directly execute the DCC control with the appropriate compensation output image signal without the time delay.

An exemplary embodiment of changing the frame frequency according to the differences between the input image signals of the previous and later frames will be described with reference to FIG. 4.

Figure 4:
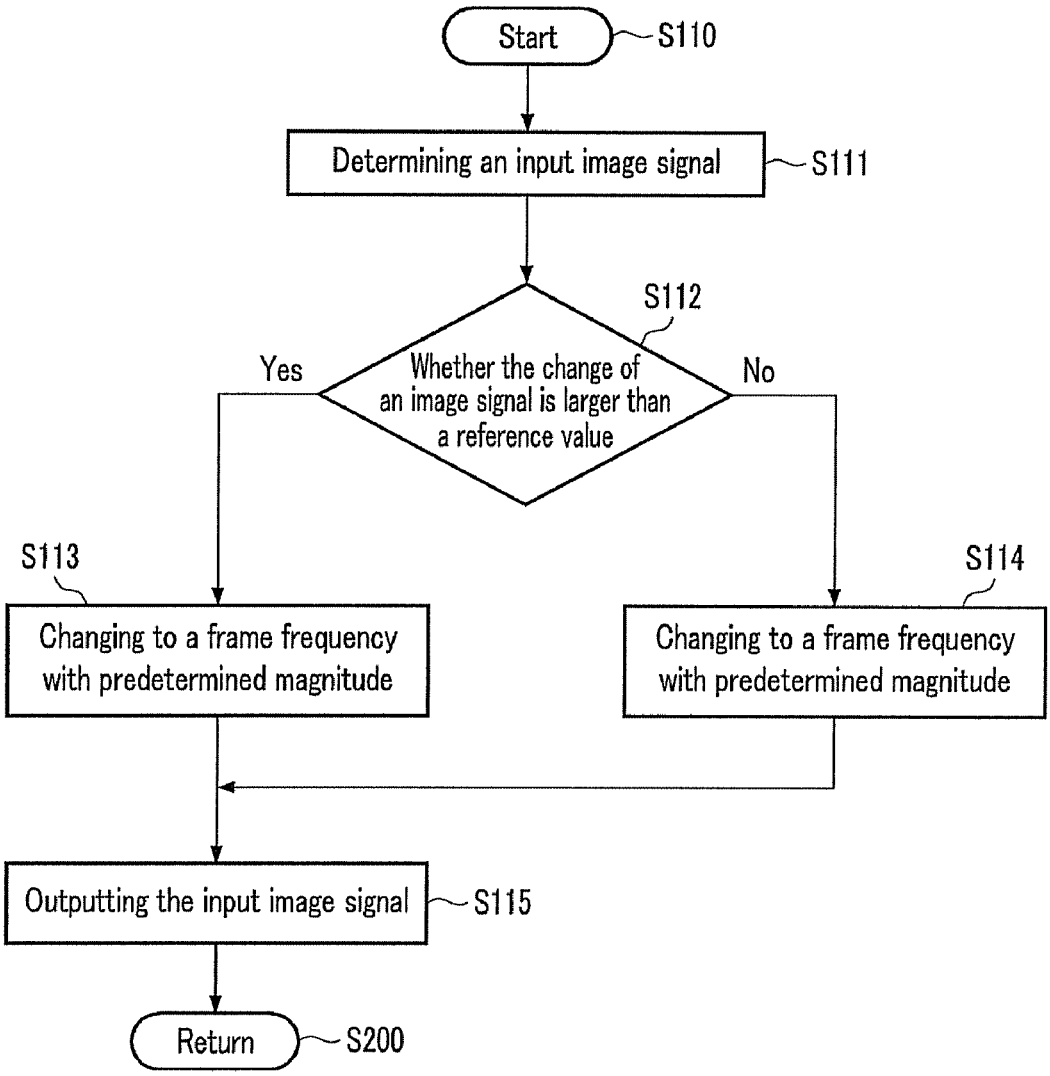

FIG. 4 is an operation flowchart of an exemplary signal controller according to another exemplary embodiment of the present invention.

Firstly, if the operation is started, the signal processor 610 reads the input image signal R, G, and B of the previous and later frames (S111), and determines whether differences between the input image signals R, G, and B are greater than a previously determined reference value (S112). That is to say, it is determined whether the differences between the input image signals R, G, and B of the previous and later frames are relatively large such that an image that is rapidly changed is displayed, or if the differences between the input image signals R, G, and B of the previous and later frames are relatively small such that an image that is slowly changed is displayed.

The steps of reading the input image signals R, G, and B (S111) and determining the differences between the input image signals R, G, and B of the previous and later frames (S112) of FIG. 4 may be executed in the signal processor 610. According to alternative exemplary embodiments, results may be processed and determined outside of the signal controller 600 and transmitted to the signal processor 610. In the exemplary embodiment, when the signal controller 600 processes the data by only using the data enable signal DE, the determined result may be transmitted to the signal controller 600 by using the vertical synchronization signal Vsync and the horizontal synchronization signal Hsync. That is to say, when the vertical synchronization signal Vsync has a high value, it may be represented that the differences between the input image signals R, G, and B of the previous and later frames are large.

When the difference between the determined input image signal R, G and B and the input image signal R, G and B of the previous frame is larger than the reference value, the signal processor 610 changes the frame frequency to the predetermined frame frequency of about 60 Hz (S113). However, when the difference between the determined input image signal R, G, and B, and the input image signal R, G, and B of the previous frame is less than the reference value, then the signal processor 610 changes the frame frequency to the predetermined frame frequency of about 30 Hz (S114). Here, the image is displayed with the fast frame frequency in the case of a large difference between the input image signals R, G, and B of the previous and later frames compared with the case of a small difference. The reference value, which is compared between the input image signals R, G, and B and the frequency values of each frame to display the images may have various combinations according to the exemplary embodiment.

Next, the input image signal that is changed to the predetermined frame frequency is output (S115).

In the present exemplary embodiment, when 60 Hz, or about 60 Hz, is used as the frame frequency of high speed and 30 Hz, or about 30 Hz, is used as the frame frequency of low speed in the case of a multiple number, the data are transmitted in the even frames or the odd frames, but when the relations between the frame frequency are not a multiple number as in the exemplary embodiment of FIG. 3, it is preferable to calculate the inactive pixel row number of FIG. 3. In this case, the contents regarding (S15) and (S16) of FIG. 3 may be directly applied to the embodiment shown in FIG. 4.

Accordingly, although the frame frequency is changed to the different magnitude according to the types of the input image signals, because the input image signals have the pixel frequency with the same magnitude regardless of their types, the charging time of the pixels is constantly maintained. Also, because the constant pixel frequency is maintained, rapid changes of the pixel frequency are generated such that the abnormal safe mode of the operation of the signal controller is not generated. In addition, whenever the pixel frequency of the safe range is maintained, the receiving operation of the stable signal is formed.

Also, as described above, when the change of the displayed image is large, the rapid frame frequency is displayed, and when the change of the displayed image is small, the slow frame frequency is displayed, thereby reducing the power consumption of the LCD. Particularly, the time of using a battery, that is the battery life, may be increased in the case of a portable terminal such as a laptop.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An apparatus for driving a display device, the apparatus comprising:

a signal controller which converts an input image signal of a first frame frequency into a plurality of output image signals of a second frame frequency, and outputs the plurality of output image signals; and a data driver which selects data voltages corresponding to the plurality of output image signals among one group of gray voltages and applies the data voltages to pixels, wherein the input image signal includes at least a first input image signal and a second input image signal, the plurality of output image signals includes a first output image signal corresponding to the first input image signal and a second output image signal corresponding to the second input image signal, frame frequencies of the first output image signal and the second output image signal are different from each other, and wherein the signal controller calculates an inactive pixel row number based on the second frame frequency and changes the inactive pixel row number to control the horizontal frequencies and the pixel frequencies of the first output image signal and the second output image signal, respectively, to be substantially equal to each other.

2. The apparatus of claim 1, wherein the signal controller changes a pixel frequency of the input image signal of the first frame frequency to the plurality of output image signals of the second frame frequency.

3. The apparatus of claim 1, wherein the first input image signal is a video image signal, and the second input image signal is a film image signal.

4. The apparatus of claim 3, wherein the signal controller includes a frame memory.

5. The apparatus of claim 4, wherein the signal controller includes a line memory.

6. A method for driving a display device, the method comprising:

inputting at least two different types of input image signals;

reading the input image signals to confirm the different types of the input image signals;

changing a frame frequency of each type of input image signals into a predetermined frame frequency according to the frame frequency of each type of input image signals;

changing a number of inactive pixel rows in which an image is not displayed according to the predetermined frame frequency to control the horizontal frequencies and the pixel frequencies of the different types of the input image signals, respectively, to be substantially equal to each other; and outputting the input image signals to display the image.

7. The method for driving a display device of claim 6, wherein a formula $$(v_active+v_blank1)\times f_v1=(v_active+v_blank2)\times f_v2$$

is used in changing the number of inactive pixel rows, wherein f_v1 is a frame frequency of the input image signal before the changing, f_v2 is a frame frequency of the input image signal after the changing, v_active is a number of active pixel rows, v_blank1 is a number of inactive pixel rows before the changing, and v_blank2 is a number of inactive pixel rows after the changing.

8. The method for driving a display device of claim 6, wherein inputting at least two different types of input image signals includes inputting a video image signal and a film image signal.

9. The method for driving a display device of claim 8, wherein changing a frame frequency of each type of input image signal into the predetermined frame frequency includes changing a frame frequency of the video image signal to about 120 Hz and changing a frame frequency of the film image signal to about 72 Hz.

* * * * *